United States Patent [19]

Johnson

[11] 4,006,955

[45] Feb. 8, 1977

[54] CARD RETAINER

[75] Inventor: Melvin L. Johnson, Lombard, Ill.

[73] Assignee: GTE Automatic Electric Laboratories Incorporated, Northlake, Ill.

[22] Filed: Dec. 22, 1975

[21] Appl. No.: 642,967

[52] U.S. Cl. ..... 339/91 R; 339/17 C; 339/75 R

[51] Int. Cl.[2] ..... H01R 13/54

[58] Field of Search ..... 317/101 DH; 339/75 R, 339/91 R, 75 M, 17 C, 17 L, 17 LC, 17 LM, 17 M

[56] References Cited

UNITED STATES PATENTS

| | | | |
|---|---|---|---|
| 3,803,533 | 4/1974 | Taplin | 339/91 R |
| 3,829,741 | 8/1974 | Athey | 317/101 DH |
| 3,932,016 | 1/1976 | Ammenheuser | 317/101 DH X |

OTHER PUBLICATIONS

"Lock For Circuit Card", J. Gallagher, IBM Technical Disclosure Bulletin, p. 12, vol. 6, No. 7, Dec. 1963.

*Primary Examiner*—Roy Lake
*Assistant Examiner*—E. F. Desmond

[57] ABSTRACT

A printed circuit card retainer formed of a unitary elongated ring element having an inwardly projecting tongue at one end and a pair of outwardly projecting hooked tines at the opposite end. Whereby in use the tongue is hooked over the edge of a printed circuit card while the tines are passed around a connector mounting bar onto which they are hooked.

1 Claim, 4 Drawing Figures

CARD RETAINER

BACKGROUND OF THE INVENTION

1. Field of the Invention

This invention relates to printed circuit card assemblies of the type having an edge connector arranged for insertion into a corresponding connector of a backplane, and more particularly to a device for retaining the printed circuit card in place.

2. Description of the Prior Art

In the present state of the art, it is the usual practice in large electronic systems to arrange printed circuit boards or cards each in a vertical plane with the edge connectors at one end. The corresponding connector jacks are then arranged on end, with the top and bottom ends fastened to two horizontal bars. The printed circuit board is supported along its top and bottom edges by some sort of plane usually with restraining guides.

Generally, unless the equipment is designed for military or mobile use no provision is made to lock the cards in their respective positions since the force of each of the large number of terminals of the connector is more than adequate to hold them in place. But, when the equipment is located at a site where there is some degree of vibration, there may be a slight amount of creep, whereby the card may come out of its connector in time. This is not normally a problem on full size cards since the maintenance personnel can readily detect and correct this before electrical contact is lost. However, when short cards are jacked into connectors of a backplane where they are not visible to the maintenance personnel without the removal of other cards it becomes a major problem.

SUMMARY OF THE INVENTION

Accordingly it is a principle object of this invention to provide a circuit board retainer that is of simple and inexpensive construction.

In accomplishing this and other objects of the present invention, there has been provided a unitary elongated ring element having an inwardly extending tongue at one end and a pair of outwardly projecting hooked tines at the opposite end, whereby in use the tongue is hooked over the edge of a printed circuit card while the tines are passed around a connector mounting bar onto which they become hooked.

BRIEF DESCRIPTION OF THE DRAWING

The novel features which are believed to be characteristic of the invention both as to its form and method of use will be more apparent from the following detailed description, taken in conjunction with the drawings, in which.

DESCRIPTION OF THE PREFERRED EMBODIMENT

Figure 1:
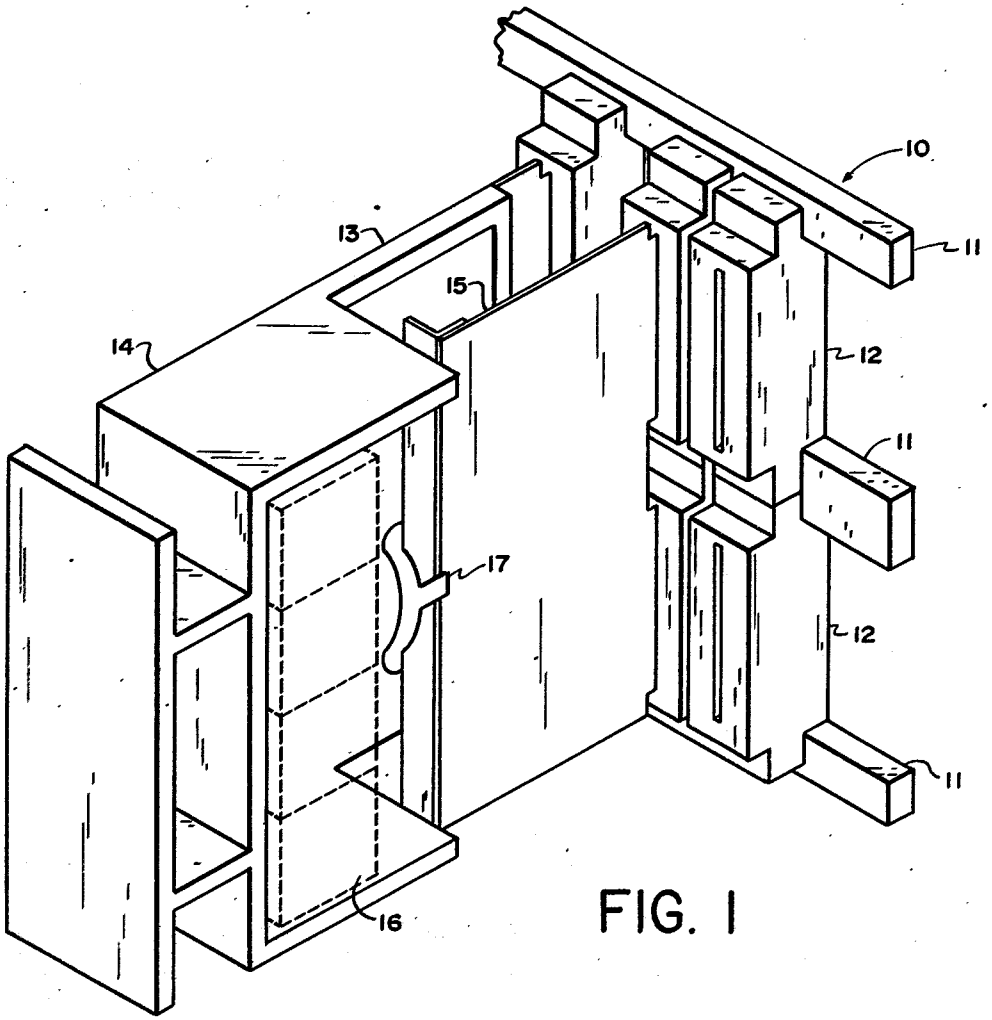
FIG. 1 is a perspective assembled view of a portion of a printed circuit file including a short printed circuit card.

As shown in FIG. 1, a card file assembly 10 for inserting printed wiring boards includes the connector mounting bars 11 with the connector jacks 12 mounted thereon. The supports and guides for the printed circuit cards which would normally be located above and below the cards are not material to the concept of this invention and are not shown in order to keep the illustration as simple as possible.

A file of this type can mount a large number of printed circuit cards, however when the cards have large bulky components 16 such as relays mounted thereon the density is decreased, and when cards of the type illustrated at 13 with a large combination heat sink and handle 14 thereon at the facing edge of the card there is a large space adjacent the connectors but not acessible from the front without the removal of a card such as 13. To keep the overall equipment as compact as possible shorter cards 15 known as hot dog cards are inserted in these spaces. These cards 15 are not readily accessible and should they begin to work out of their connector sockets, this would not be detected until the electrical contact with the socket contacts was interrupted. This obviously means a break down of the operation of the equipment which is undesirable. To prevent the occurrence of such actions by the hot dog cards, a simple means, that would not be in conflict with the accompanying structures, had to be devised.

Figure 4:
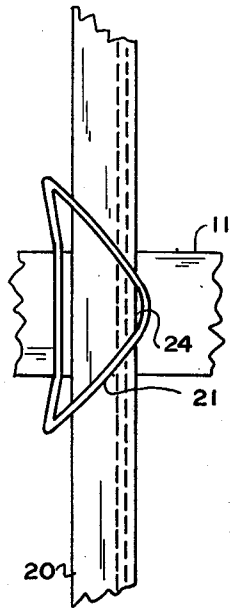
FIG. 4 is a top end view of the device of the present invention as inserted in a file.
Figure 2:
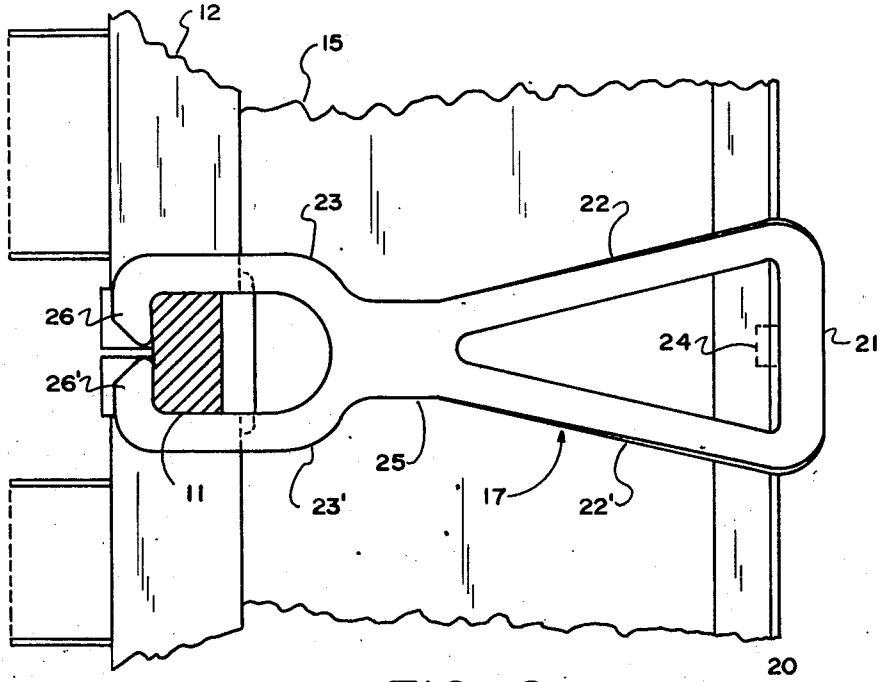
FIG. 2 is a frontal view of the device of the present invention as inserted in a file.
Figure 3:
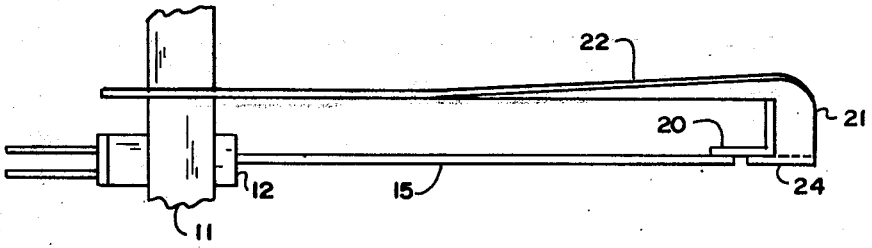
FIG. 3 is a side view of the device of the present invention as inserted in a file.

Such a device according to the present invention is that shown as item 17 in FIG. 1, and more completely disclosed in FIGS. 2, 3 and 4.

FIGS. 2, 3 and 4 show in detail the circuit card retainer. It consists of a basic loop member comprised of the two flexible side members 22 and 22' joined at the top by a cross-member 21 and at the bottom by the linking portion 25. Also, connected to the linking portion 25 are a pair of flexible tines or fingers 23 and 23' which are terminated by corresponding projections 26 and 26', thus forming a pair of oppositely facing hooks. These hooks are flexible and can be twistably displaced to move them into position to encompass a card file connector mounting bar 11. The opposite end of the card retainer has a tongue or tab 24 mounted on cross-member 21 facing inwardly into the loop formed with the associated members 22 and 22'. Again, by twisting member 21 into an arc about the longitudinal axis of the retainer and incidentally also imparting a twist to members 22 and 22' the tongue can be resiliently positioned over the end of a card 15. Card 15 may have a reinforcing angle 20 along its terminal edge, in which case the member 21 would remain with the arc imparted to it during installation in its mounted position.

An additional feature of this device is obtained from the method of securing the front edge of the card. As the retainer bends over the card it forces the arms 22 or 22' of the retainer to twist. This twist acts as a spring and forces the card to seat more securely in its mating connector.

As presently envisioned the card retainer 17 is punched out of a gray fiber material, however the use of other plastics or sheet metal or even of molding of the device is not precluded, since the essential characteristic of the material is that it be semi-rigid yet possess a degree of springiness.

What is claimed is:

1. A retainer for locking a printed circuit card into its associated connector in a file wherein said file includes cross-bars onto which are mounted said connectors, comprising: an elongated planar ring having a tongue extending inwardly from the periphery of said ring, the tongue and associated portion of said ring being flexible enough to be displaced for hooking over the edge of a printed circuit card in said file, and a pair of hooked tines at the opposite end of said ring projecting outwardly, the hook portions of said tines facing each other, said tines being flexible enough to permit the hooked portions to be displaced out of the plane of said ring for passage of said hooked portions past said cross-bar and to return to their original position to hook around said cross-bar, to thereby lock said printed circuit card in its associated connector.

* * * * *